United States Patent [19]

Ukai

[11] 3,952,242

[45] Apr. 20, 1976

[54] AUTOMATIC VOLTAGE REGULATOR WITH OPTICAL FEEDBACK

[75] Inventor: Takeshi Ukai, Tokyo, Japan

[73] Assignee: Ricoh Co., Ltd., Tokyo, Japan

[22] Filed: June 30, 1972

[21] Appl. No.: 268,148

Related U.S. Application Data

[63] Continuation of Ser. No. 28,099, April 13, 1970, abandoned.

[30] Foreign Application Priority Data

Apr. 11, 1969 Japan ..... 44-28048

[52] U.S. Cl. ..... 323/21; 307/252 N; 307/252 Q; 315/158; 315/194; 323/8; 323/24; 323/34

[51] Int. Cl.[2] ..... G05F 1/44

[58] Field of Search ..... 323/21, 8, 22 SC, 24, 323/34, 37; 315/151, 158, 194; 307/252 N, 252 Q

[56] References Cited

UNITED STATES PATENTS

| | | | |
|---|---|---|---|
| 3,189,751 | 6/1965 | Winckel | 323/34 UX |
| 3,252,010 | 5/1966 | Buttenhoff | 307/252 N |
| 3,333,179 | 7/1967 | Freeman | 321/45 S |
| 3,335,318 | 8/1967 | Yancey | 323/21 |
| 3,381,212 | 4/1968 | Peltola et al. | 323/21 |
| 3,593,112 | 7/1971 | Coats et al. | 323/34 X |

OTHER PUBLICATIONS

GE SCR Manual, 4th Ed., 1967, pp. 282–284.

G.E. SCR Manual, 3rd Ed., 1964, pp. 131–137.

*Primary Examiner*—Gerald Goldberg

*Attorney, Agent, or Firm*—Cooper, Dunham, Clark, Griffin & Moran

[57] ABSTRACT

An automatic voltage regulator employing an optical feedback system, in which a luminous element, whose intensity varies in response to the variation in a regulated voltage, illuminates a photosensitive element which generates a feedback signal responsive to intensity of light. More precise voltage regulation is possible. Furthermore, a "soft-start" circuit is provided which can arbitrarily select a rising time of a regulated voltage to a predetermined magnitude, starting always from a predetermined phase angle of the voltage.

6 Claims, 2 Drawing Figures

TAKESHI UKAI
INVENTOR

BY

ATTORNEY

AUTOMATIC VOLTAGE REGULATOR WITH OPTICAL FEEDBACK

This is a continuation, of application Ser. No. 28,099 filed Apr. 13, 1970, now abandoned.

BACKGROUND OF THE INVENTION

The present invention relates to generally a voltage regulator and more particularly an automatic voltage regulator employing an optical feedback system for more precise voltage regulation.

A wide variety of voltage regulators is known, but in the conventional voltage regulator, the variation in controlled output voltage is directly fed back for more precise control over an output voltage so as to maintain it at a constant magnitude. The conventional voltage regulator commonly requires an amplifier complex in construction and expensive to manufacture. Furthermore, relatively large space is commonly required in the voltage regulator or voltage regulation system for incorporating the amplifier for the feedback system. In the more recent electronic circuits, more precisely controlled voltages are required so that the above-described defects present more serious problems.

SUMMARY OF THE INVENTION

It is therefore a general object of the present invention to provide a novel automatic voltage regulator employing a phase regulated controlled rectifier element and an optical feedback system for more precise voltage regulation.

Another object of the present invention is to provide a novel automatic voltage regulator employing an optical feedback system and having a "soft-start" circuit which can apply a voltage to a load at a predetermined phase angle of the first or second half cycle and gradually increase the voltage applied to the load by changing the phase angle gradually to earlier times in the succeeding half cycles.

Another object of the present invention is to provide a novel automatic voltage regulator employing an optical feedback system which can preset more precisely a magnitude of a controlled voltage.

Another object of the present invention is to provide a novel automatic voltage regulator employing an optical feedback system compact in size, light in weight, highly reliable in operation and inexpensive to manufacture.

A luminous element such as a semisubminiature lamp is used, which emanates light whose intensity varies as a function of a voltage applied thereto, which may be the controlled voltage or a voltage in proportion thereto. A photosensitive element such as a solar battery intercepts the light from the luminous element and generates a signal in response to the variation in intensity of the light in order to feed back the variation in controlled voltage to a voltage regulating device.

This optical feedback system employed in the present invention is exceedingly advantageous for voltage regulation with a higher degree of accuracy because the intensity of light from the luminous element may vary in proportion to the square of a voltage applied thereto. This means that a voltage variation can be more precisely detected so that the more precise voltage regulation becomes possible in a very simple manner and by a very simple device hitherto unattained by the conventional art.

In one embodiment of the present invention, a semisubminiature lamp whose intensity of light varies as a function of an output voltage is connected in parallel with a load, to which is applied a regulated output voltage. A photocell whose output varies in response to the intensity of light of the lamp is spaced apart therefrom by a suitable distance. The output of the photocell is used as a feedback signal, thereby more precise voltage regulation becomes possible.

According to one aspect of the present invention, an adjustable resistor means is connected in series to the lamp, whereby a magnitude of a controlled voltage may be determined more precisely.

According to one aspect of the present invention, by making and closing a very low power starter switch, a load having a large capacity may be energized and de-energized in a simple yet well safeguarded manner.

The above and other objects, features and advantages of the present invention will become more apparent from the following description of one illustrative embodiment thereof taken in conjunction with the accompanying drawing.

DESCRIPTION OF THE PREFERRED EMBODIMENT

Figure 1:
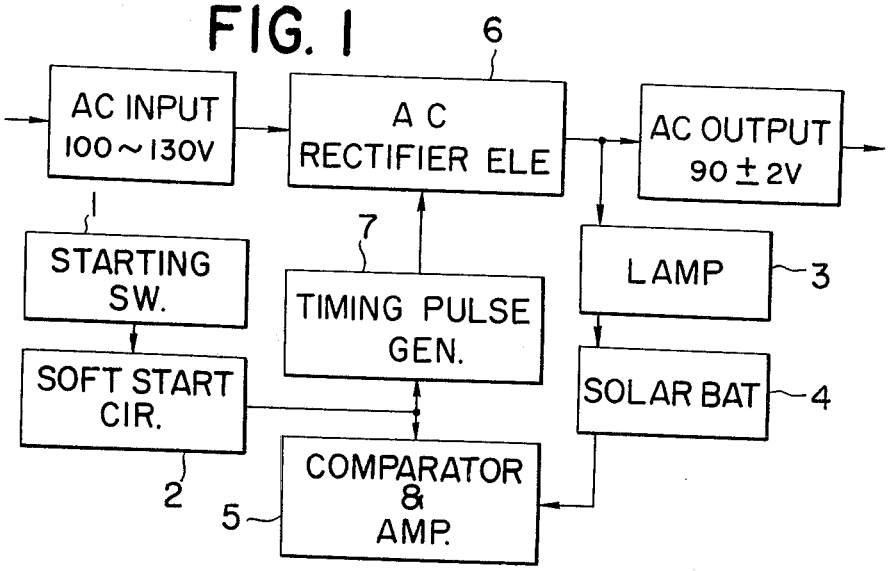
FIG. 1 is a block diagram of one embodiment of the present invention.
Figure 2:
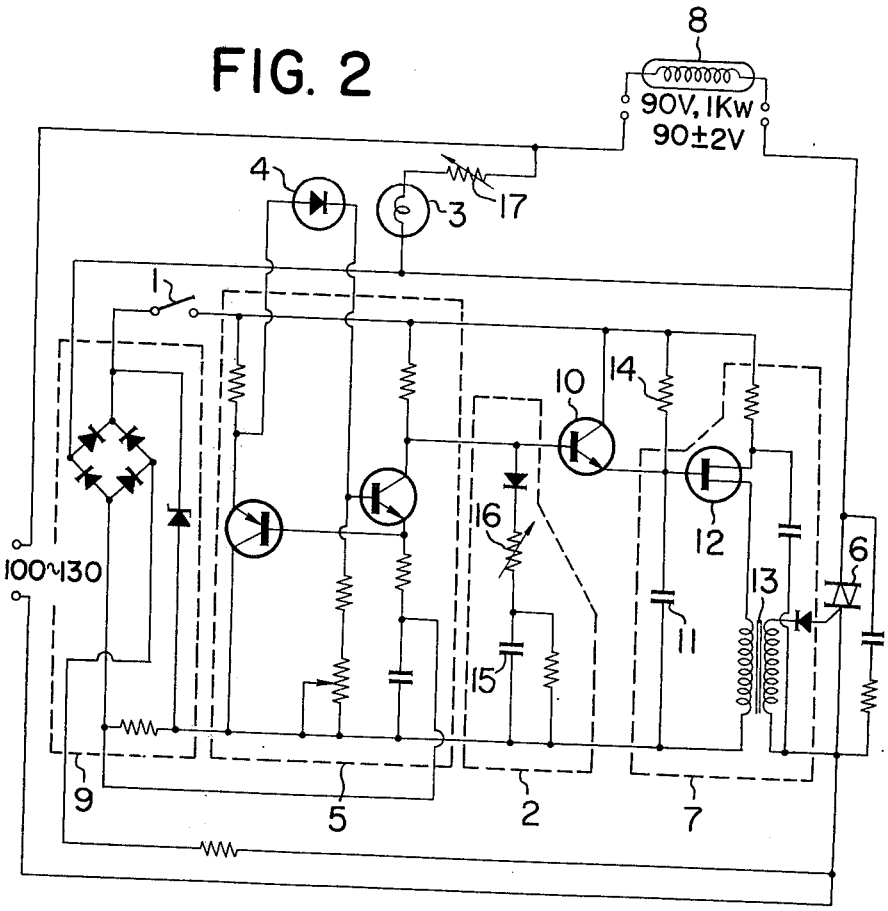
FIG. 2 is an electric circuit diagram thereof.

Referring to the accompanying drawing, reference numeral 1 designates a starting switch 2, a soft-start circuit for automatically gradually increasing the output voltage; 3, a subminiature lamp whose illumination is in proportion to the output voltage; 4, a photocell or solar battery for signalling the variation in output voltage to the regulator in response to the amount of light emanating from the subminiature lamp 3; 5, a comparator and amplifier for controlling the regulator in response to a signal from the solar battery 4; 6, an AC controlled rectifier element for varying the phase of the output voltage; 7, a timing pulse generator for driving the rectifier element 6; 8, a lamp load connected to the output side; 9, a power source circuit for supplying the power to the control circuit of the regulator; 10, a transistor for controlling the timing of the pulse generation by the timing pulse generating circuit 7; 11, a charging and discharging capacitor interconnected in the pulse generating circuit 7; 12, an unijunction transistor which is driven when a voltage charged across the capacitor 11 reaches a predetermined value; 13, a pulse transformer for applying the pulses from the transistor 12 to the gate of the rectifier element 6; 14, a predetermined-phase-angle-starting resistor for charging the capacitor 11 through this resistor 14 when the transistor 10 is in the nonconductive state; 15, a capacitor for soft-start; 16, an adjustable resistor for varying the charging time of the capacitor 15; and 17, an adjustable resistor for varying a reference illumination of the amp 3.

Next, the mode of operation of the device will be described when a tungsten filament lamp of 90V and 1kW is connected as a load. When the input voltage is applied to the device when the switch 1 is open, no pulse is generated in the timing pulse generating circuit 7, so that the rectifier element 6 is OFF, whereby the load or tungsten filament lamp 8 is not lighted. When the switch 1 is closed, power is supplied from the power source circuit 9 to the comparatoramplifier 5, the soft-start circuit 2; the transistor 10, the timing pulse generating circuit 7; the rectifier element 6; the resistor 14, the solar battery 4, etc., which constitute the control circuit. At the moment when the switch 1 is closed, the capacitor 15 is discharged, so that the transistor 10 is OFF, whereby the capacitor 11 is not charged through the transistor 10.

The capacitor 11 is completely discharged at the time of initial closing of the switch 1. When the switch 1 is closed, there is applied to the capacitor 11, through the resistor 14, direct current from the output of the rectifier bridge in the power supply 9. This rectifier bridge supplies full wave rectified alternating current which is only slightly filtered, and thus has a strong alternating component having double the frequency of the AC supply. Initially, the transistor 10 is not conducting and the capacitor 11 is therefore charged only through the resistor 14. The value of that resistor is selected so that if the switch 1 is closed at the beginning of a half cycle, the charge on capacitor 11 builds up to the point where the transistor 12 starts conducting late in the same half cycle. Preferably, transistor 12 starts to conduct about 160° to 175° after the start of the half cycle.

A new charging cycle starts again with the next half wave ripple in the potential supplied to the capacitor 11. Hence, when the switch 1 is closed, the transistor 12 and capacitor 11 cooperate to generate a control pulse at a predetermined phase angle of the power source voltage, so that the element 6 is opened, starting the load at the same phase angle, late in the half cycle, at least after the first current pulse through the load, and hence with a small current supplied.

When transistor 12 becomes conductive, it develops a sharply peaked current pulse due to its negative resistance characteristic. This pulse completely discharges capacitor 11 and is communicated through transformer 13 to the control electrode of rectifier element 6, switching it ON, i.e., to its low impedance condition. It remains in that condition until the applied potential reverses at the end of the half-cycle.

Rectifier element 6 is connected in parallel with the input terminals of the rectifier bridge supplying the soft start circuit, so that once capacitor 11 is discharged by transistor 12 during one half-cycle, it remains discharged until the beginning of the next half-cycle.

While the tripping of the element 6 may not occur exactly at the desired phase angle on the half cycle existing at the time switch 1 is closed, due to transient conditions, it will nevertheless be synchronized at least the second time it is tripped and on all succeeding half cycles.

Next, the capacitor 15 is gradually charged, so that the input current to the transistor 10 is gradually increased, thereby flowing the collector-to-emitter current. The capacitor 11 is therefore also charged by the transistor 10. It is noted that the more the capacitor 15 is charged, the more the capacitor 11 is charged. Thus, the pulse generation cycle is gradually increased, to that the control angle for conducting the rectifier element 6 becomes gradually reduced, whereby the effective voltage applied across the load is increased. It should be noted that the foregoing is the description of the phenomena which occur within about two seconds after the switch 1 is closed, that is the explanation of the soft-start.

When a predetermined voltage is applied across the load, the lamp 3 connected in parallel to the load through the resistor 17 gives illumination in proportion to the voltage across the load. The light from the lamp 3 is intercepted by the solar battery 4 spaced apart from the lamp 3 by a predetermined distance thereby generating a voltage in proportion to the amount of light impinged thereupon and increasing or decreasing the base current of the transistor 10 through the voltage-comparator-amplifier 5. More specifically, when the illumination of the subminiature lamp 3 is in excess of a predetermined value, the voltage generated by the solar battery 4 is increased, thereby limiting the current flowing through the transistor 10. Therefore, it will take a longer time before the capacitor 11 is charged by the current from the emitter of the transistor 10 and the pulse generation cycle becomes longer so that the control angle at which the rectifier element 6 is driven conductive becomes larger, thereby decreasing the effective voltage across the load. On the other hand, when the illumination of the lamp 3 is less than a predetermined value, the effective voltage across the load is increased. In this manner, the voltage across the load 17 can be maintained at a constant value. It will be readily seen that the load voltage may be varied by varying a reference illumination of the lamp 3. This can be accomplished by adjusting the adjustable resistor 17 and in accordance with an adjusted value of the resistor 17, the voltage across the load may be automatically controlled at a predetermined value.

By the adjustment of the adjustable resistor 16, the rising time of the input voltage at the start may be arbitrarily selected so that the device of the present invention is well suited, for example, either for lighting a tungsten filament lamp through which a heavy initial current flows when it is lighted by a conventional method, or for starting a motor which must have its current limited at starting and whose rotational speed must be gradually increased.

Another novel feature of the present invention is that the output voltage appears, at least after the first current pulse through the load at a predetermined phase angle (160° to 175°) so that no excess current and voltage are applied to the load circuit as well as the rectifier element 6, thereby the breakdown thereof can be effectively prevented.

The present invention has been so far described with particular reference to one illustrative embodiment thereof, but it will be understood that variations and modifications can be effected without departing from the true spirit of the present invention as described hereinabove and as defined in the appended claims.

I claim:

1. Electrical power regulator apparatus, comprising:

a. a load to be supplied with regulated electrical power from an alternating current source;

b. a bidirectional controlled rectifier element having two principal electrodes and a control electrode, said element being connected through said principal electrodes in series with the load and with said source of alternating current, said element having a high impedance condition in which it presents a high impedance to potentials of either polarity between said principal electrodes in the absence of a signal pulse at said control electrode, and being operable from said high impedance condition to a low impedance condition between said principal electrodes in response to a signal pulse received at said control electrode, and remaining in the low impedance condition until the potential between the principal electrodes returns to zero;

c. control means for supplying a signal pulse to said control electrode including:

1. rectifier bridge means having input terminals connected across said controlled rectifier element and output terminals;
2. starting switch means operable at any time to complete a circuit between said output terminals;
3. first transistor means having two principal electrodes and a control electrode;
   i. means including said starting switch means connecting said principal electrodes to the output terminals;
   ii. means coupling one principal electrode of the first transistor means to the control electrode of the controlled rectifier element;
4. first means for controlling the potential of the control electrode of the first transistor means, comprising:
   i. a first branch circuit connected through said switch means between said output terminals, said branch circuit including a first resistor and a first capacitor in series;
   ii. a connection between the control electrode of the first transistor means and the common junction of the resistor and capacitor;
   iii. said resistor and capacitor being proportioned so that if the capacitor is fully discharged at the beginning of a half cycle of said source, it is charged through said resistor to a potential sufficient to produce a signal pulse at the control electrode of the controlled rectifier element before the end of the half cycle;
   iv. each said signal pulse being effective to discharge said capacitor, and said controlled rectifier element being effective when in its low impedance condition to shunt said input terminals of the rectifier bridge means and thereby to prevent further charging of said capacitor during any half cycle after a signal pulse is generated;
   v. said first potential controlling means being effective to produce a series of said signal pulses during at least all but the first of a corresponding series of half cycles beginning with the half cycle during which the switch means is closed;
5. second means for controlling the potential of the control electrode of the first transistor means, comprising:
   i. second transistor means having two principal electrodes connected to the terminals of said first resistor and a control electrode;
   ii. a second branch circuit connected through said switch means between said output terminals and parallel to said first branch circuit, said second branch circuit including in series a second resistor, a diode and a second capacitor; and
   iii. a third resistor in parallel with the second capacitor, said third resistor and said diode cooperating to hold a charge on said second capacitor for more than one half cycle of said source;
   iv. means coupling the control electrode of the second transistor means to the common junction of the second resistor and the diode;

v. said second potential controlling means being effective when the switch means remains closed during a succession of half cycles to increase gradually the power per cycle supplied to the load by increasing the rate of charge of the first capacitor, thereby advancing the signal pulses to earlier times during the successive half cycles.

2. Electrical power regulator apparatus as in claim 1, in which:

a. said load comprises a tungsten filament lamp;

b. said second means for controlling the potential of the control electrode of said first transistor means includes feedback means comprising:

1. a feedback lamp connected in parallel with said tungsten filament lamp and producing illumination varying as a function of the voltage supplied to the tungsten filament lamp;
2. light responsive means illuminated by said feedback lamp; and
3. means controlled by said light responsive means for controlling the rate of charge of said second capacitor.

3. Electrical power regulator apparatus as in claim 2, including:

a. a first variable resistor connected in series with said feedback lamp for varying the ratio between the voltage supplied to the load and the illumination of the feedback lamp; and b. a second variable resistor connected in series with said diode for varying the rate of charge of the second capacitor.

4. Electrical power regulator apparatus as in claim 2, in which said feedback lamp produces illumination varying in proportion to the voltage supplied to the tungsten filament lamp.

5. Electrical power regulator apparatus as in claim 2, in which said feedback lamp produces illumination varying in proportion to the square of the voltage supplied to the tungsten filament lamp.

6. Electrical power regulating apparatus, comprising:

a. a load to be supplied with regulated electrical power from an alternating source;

b. a bidirectional controlled rectifier element having a control electrode and principal electrodes connected in series with the load;

c. control means for supplying a signal pulse to said control electrode, including:

1. rectifier bridge means having output terminals and input terminals connected to the principal electrodes of said controlled rectifier element;
2. starting switch means operable at any time to complete a circuit between the output terminals;
3. first transistor means having a control electrode and two principal electrodes connected through said switch means between said output terminals;
4. means coupling one principal electrode of the first transistor means to the control electrode of the controlled rectifier element;
5. a first branch circuit connected through said switch means between said output terminals, said branch circuit including a first resistor and a first capacitor in series;
6. a connection between the control electrode of the first transistor means and the common junction of the resistor and capacitor, said first transistor means being responsive to the potential at said common junction to generate a signal when said junction exceeds a predetermined potential, said resistor and capacitor being proportioned so that if the capacitor is fully discharged at the beginning of a half cycle of said source, it is charged through said resistor to produce a signal to the control electrode of the controlled rectifier element before the end of the half cycle;

7. said first transistor means being effective in response to closure of said switch means to produce a series of signals during at least all but the first of a corresponding series of half cycles beginning with the half cycle during which the switch means is closed;

8. second transistor means having a control electrode and two principal electrodes connected to the terminals of said first resistor;

9. a second branch circuit connected through said switch means between said output terminals and parallel to said first branch circuit, said second branch circuit including in series a second resistor, a diode, and a second capacitor;

10. a third resistor in parallel with the second capacitor, said third resistor and said diode cooperating to hold a charge on said second capacitor through more than one half cycle of said source;

11. means coupling the control electrode of the second transistor means to the common junction of the second resistor and the diode;

12. said second transistor means being effective when the switch means remains closed during a succession of half cycles to increase gradually the power per cycle applied to the load by increasing the rate of charge of the first capacitor, thereby advancing the signal pulses to earlier times during the successive half cycles.

* * * * *